US005383662A

United States Patent [19]

Gabrielidis

[11] Patent Number: 5,383,662

[45] Date of Patent: Jan. 24, 1995

[54] RACKET WITH IMPROVED STRINGS PATTERN

[76] Inventor: Pericles Gabrielidis, 14152 Foothill Blvd., #24, Sylmar, Calif. 91342

[21] Appl. No.: 101,628

[22] Filed: Aug. 3, 1993

Related U.S. Application Data

[63] Continuation-in-part of Ser. No. 946,258, Sep. 16, 1992, abandoned, which is a continuation of Ser. No. 807,064, Dec. 10, 1991, abandoned.

[51] Int. Cl.[6] ..... A63B 49/02

[52] U.S. Cl. ..... 273/33 R; 273/73 D

[58] Field of Search ..... 273/73 R, 73 L, 73 D, 273/29 R, 175

[56] References Cited

U.S. PATENT DOCUMENTS

| | | | |
|---|---|---|---|
| 4,802,678 | 2/1989 | Svoma | 273/73 D |
| 5,037,097 | 8/1991 | Svoma et al. | 273/73 D X |
| 5,192,072 | 3/1993 | Hong | 273/73 D X |
| 5,209,472 | 5/1993 | Tseng | 273/73 D X |

FOREIGN PATENT DOCUMENTS

| | | | |
|---|---|---|---|
| 3018354 | 11/1981 | Germany | 273/73 D |
| 4010722 | 10/1991 | Germany | 273/73 D |
| 223151 | 10/1924 | United Kingdom | 273/73 D |

*Primary Examiner*—Vincent Millin
*Assistant Examiner*—Raleigh W. Chiu
*Attorney, Agent, or Firm*—Allan M. Shapiro

[57] ABSTRACT

The tennis racket has a handle and has a hoop-like frame with an opening therein. Strings are drawn through the opening and form a substantially planar string bed which is the hitting surface of the strings within the pattern of cross strings. Outside of the string bed, at least some of the cross strings diverge from the plane, including around the corners of the string bed, and pass through their holes in the frame to stabilize the string bed and reduce vibration.

19 Claims, 3 Drawing Sheets

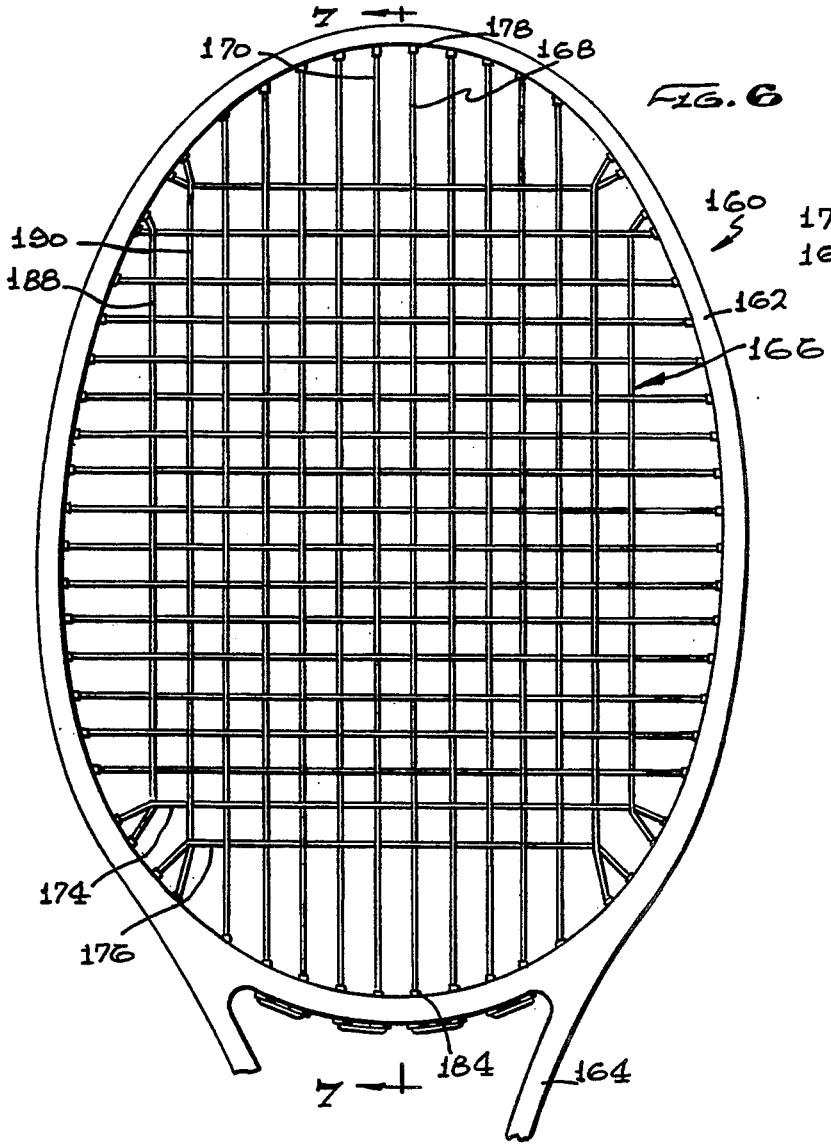
FIG. 6
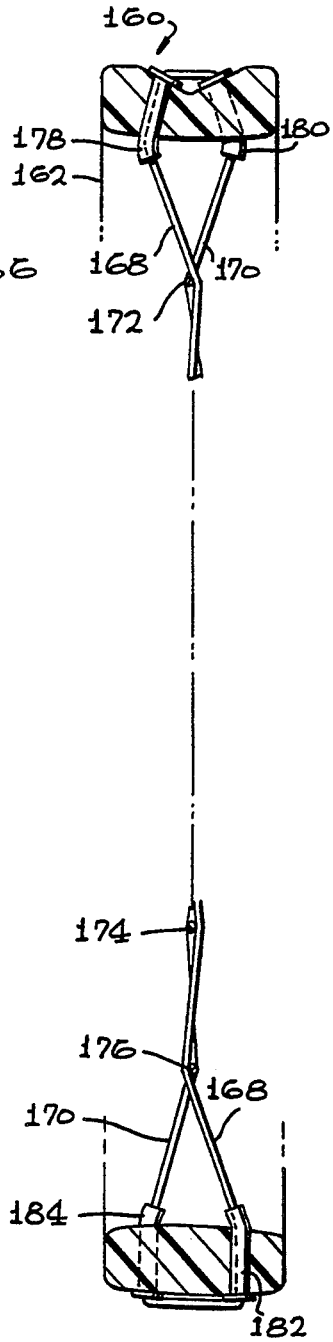
FIG. 7
FIG. 10
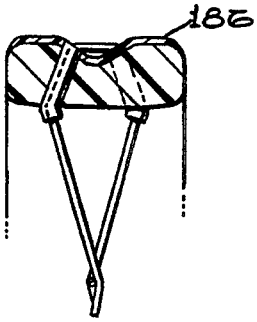

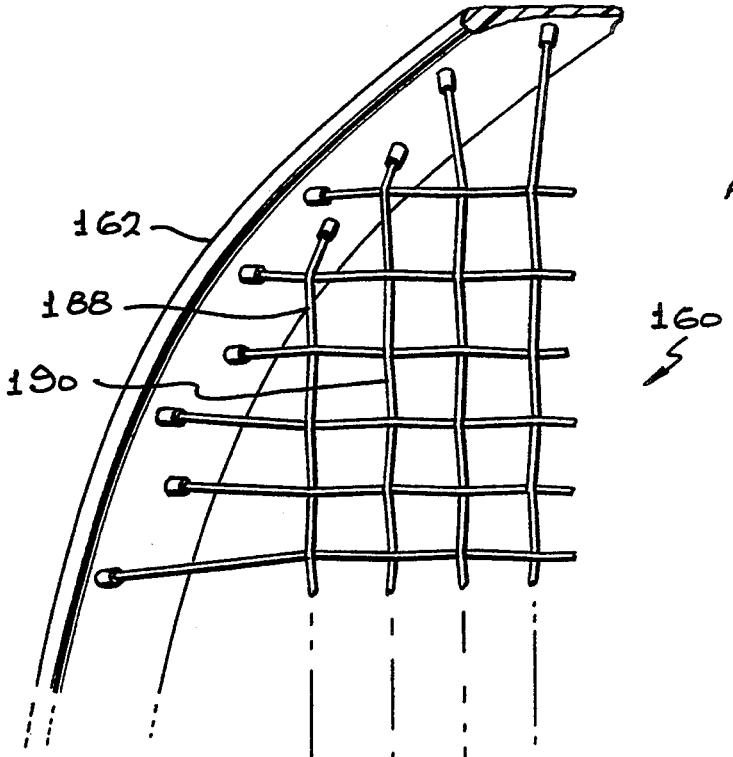
FIG. 8
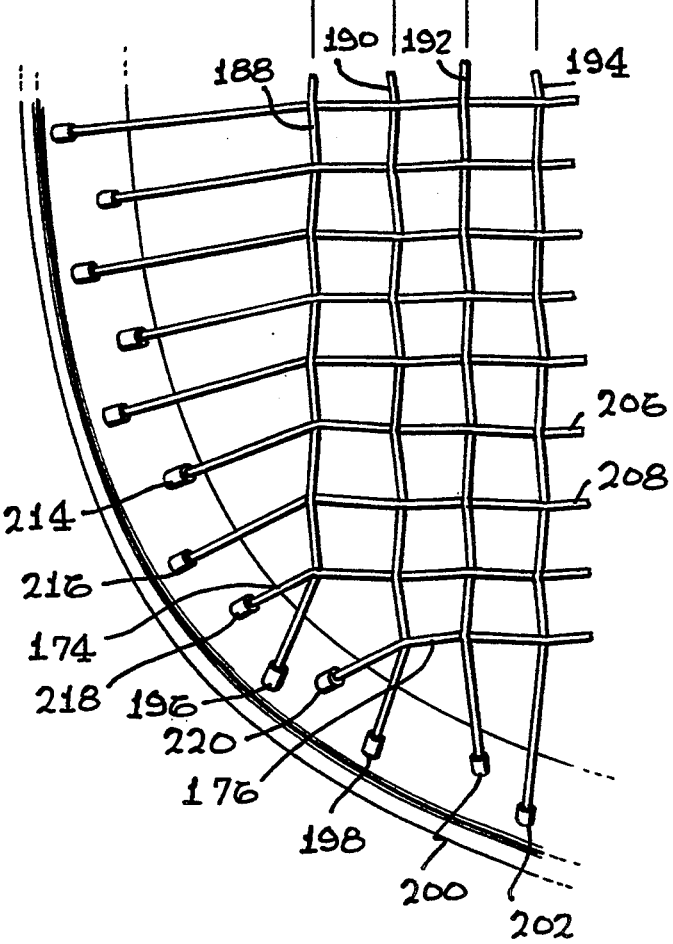
FIG. 9
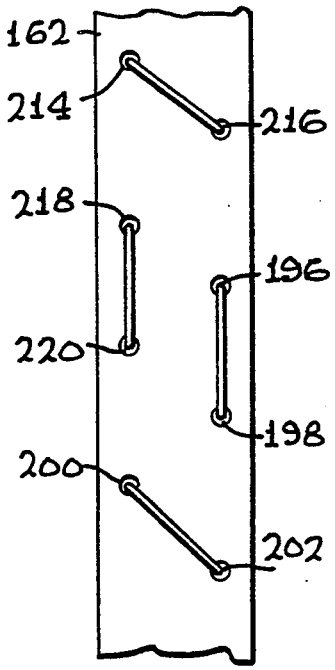

RACKET WITH IMPROVED STRINGS PATTERN

CROSS REFERENCE

This application is a continuation-in-part of my prior application, Ser. No. 07/946,258, filed Sep. 16, 1992 which, in turn, was a continuation of my earlier application Ser. No. 07/807,064, filed Dec. 10, 1991, both entitled "Racket with Improved String Pattern", now abandoned.

FIELD OF THE INVENTION

This invention is directed to a racket, such as a tennis racket, which has an improved string pattern which provides an improved support for the string bed and reduced vibration.

BACKGROUND OF THE INVENTION

The hitting surface of a tennis racket must be flat. It consists of a pattern of cross strings connected to the frame of the tennis racket to form a string bed. The cross strings are alternately interlaced or bonded where they cross. The string bed pattern must be generally uniform and, in particular, not less dense in the center than in any other area. To meet international competitive rules, a single layer string bed and a flat string bed are required. When a racket has a modern stringing pattern, to create more control, the racket is strung with more tension; and to create more power, the racket is strung with less tension. In addition, mid-size rackets are strung with slightly less tension than the over-size rackets. The present-day wide-body rackets are strung with less tension than the previous designs. Each of these designs has its strings passing through holes in the frame where the holes are substantially in the same plane as the string bed. The modern wide-body rackets are much more powerful than the previous designs, but lack feel and control. Mid-size rackets, and more particularly the over-sized rackets, when strung at recommended tensions, have a trampoline effect. The trampoline effect is to propel the ball at a higher velocity out of the string bed, but with significant loss of directional control and a significant increase in vibration. The vibration is heard and is felt in the player's arm. There is need for a racket for use in playing tennis and other similar games wherein the racket can deliver the ball or other projectile accurately and with force.

SUMMARY OF THE INVENTION

In order to aid in the understanding of this invention, it can be stated in essentially summary form that it is directed to a racket with an improved string pattern of cross strings, i.e., longitudinal and transverse strings. The racket has a frame and, within the frame, the hitting surface or string bed of the string pattern lies flat but, around the sides of the string bed, including the corners, the strings are divergent and attach to the frame away from the plane of the string pattern.

It is thus an object and advantage of this invention to provide a racket with an improved string pattern wherein the edge of the string bed formed by the cross strings is secured to the racket frame by means of divergent strings which are directed out of the plane of the string bed and which are attached to the frame on opposite sides of the string bed.

It is another object and advantage of this invention to provide a racket with an improved string pattern wherein the strings are divergent from the plane of the string bed so as to provide triangular stability to the string bed by supporting the string bed triangularly with respect to the racket frame, as seen along the length of the longitudinal and transverse strings at the edge of the string bed and around the corners of the string bed.

It is a further object and advantage of this invention to provide a racket with an improved string pattern which gives the player more control of the ball without loss of power since the racket can be strung at a lower string tension to thereby improve the quality of the player's game.

It is another object and advantage of this invention to provide a racket with an improved string pattern which reduces the trampoline effect and which reduces the vibration of the string bed to reduce player fatigue.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 6 is a front-elevational view of a second preferred embodiment of the racket with an improved string pattern in accordance with this invention wherein the longitudinal and transverse strings are divergent, including the corners, with part of the racket handle broken away.

FIG. 7 is an enlarged section taken generally along line 7—7 of FIG. 6, with parts broken away.

FIG. 8 is an enlarged perspective view, with parts broken away, showing the inter-engagement of the strings in the string bed at the corner of the racket frame in the preferred embodiment of FIG. 6.

FIG. 9 is a side-elevational view of a portion of the racket frame of FIG. 8, with parts broken away.

FIG. 10 is a view similar to FIG. 7 through the top of the frame of the embodiment of FIG. 6, but showing a wear-resistant layer on the exterior of the frame, together with guide tubes through the frame, as compared to the grommets shown in FIG. 7.

DESCRIPTION OF THE PREFERRED EMBODIMENTS

Figure 1:
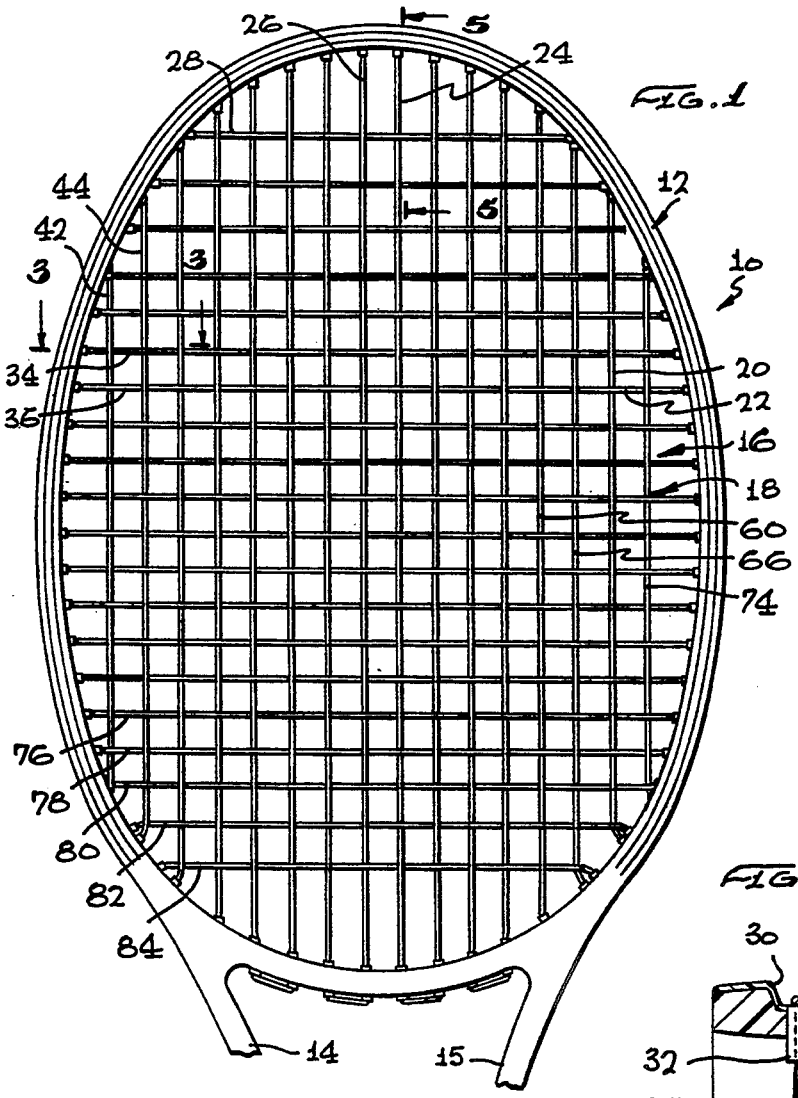
FIG. 1 is an elevational view of a first preferred embodiment of the racket with a first improved string pattern in accordance with this invention wherein some of the cross strings and some of the corner strings thereof are diverged, with the racket handle broken away.
Figure 2:
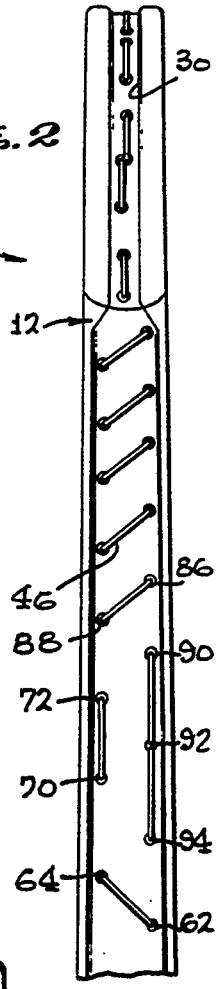
FIG. 2 is a side-elevational view thereof.

FIGS. 1 and 2 show the first preferred embodiment of the racket of this invention, which is generally indicated therein at 10. The racket 10 has a frame 12 and a handle. In FIG. 1, the handle is broken away and only handle portions 14 and 15 are shown. The handle is conventional. The overall size and shape of the racket 10 including the frame and handle comply with rules of the International Tennis Federation. Frame 12 is generally in the form of a hoop which has an interior opening 16 within which lies the string bed 18. The string bed 18, which is the hitting surface of the racket, is flat and substantially planar. It consists of a pattern of cross strings which are connected to the frame and which are alternately interlaced or bonded with a cross. The string bed has longitudinal strings, generally lengthwise of the racket. One of the longitudinal strings is indicated at 20. It also has transverse or crosswise strings, one of which is indicated at 22 in FIG. 1. The stringing pattern of the longitudinal and transverse strings is generally uniform in that the rectangular openings defined by the longitudinal and transverse strings are substantially equal throughout the string bed, although they need not be equal. The string bed is defined as the rectangular areas defined by longitudinal and transverse strings.

Figure 5:
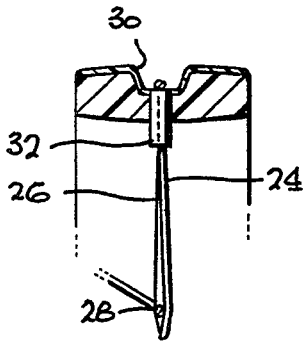
FIG. 5 is an enlarged section taken generally along 5—5 of FIG. 1.

In the racket 10 shown in FIG. 1, most of the length of each of the longitudinal strings lies in the same plane, which is the plane of the string bed. FIGS. 1 and 5 show longitudinal strings 24 and 26 which enter the interior of the frame through holes on the plane of the string bed. They intersect the transverse strings, including string 28, and are interlaced therewith. The end of the frame opposite the handle, as well as the sides of the frame, have a groove 30 within which the strings lie so that abrasion thereon is avoided. With some racket materials, a grommet 32 is required at the interface between the string and the frame materials to avoid excess wear. Thus, in the embodiment of the racket 10 shown in FIGS. 1 through 5, the longitudinal strings lie substantially in the same plane, both within the string bed and between the string bed and the frame, except in the corners on the handle end where the longitudinal strings diverge. However, most of the transverse strings lie in the plane of the string bed only within the string bed and, sideways from the string bed, and at the corners on the handle end of the string bed, these strings diverge from the plane to pass through openings in the racket frame which are on opposite sides of the plane of the string bed.

Figure 3:
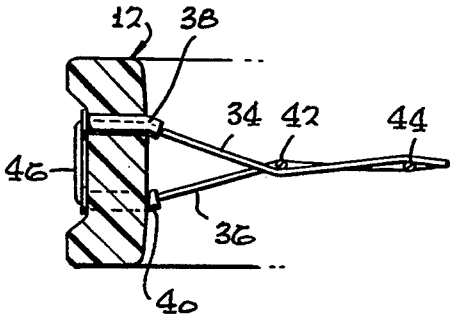
FIG. 3 is an enlarged section taken generally along line 3—3 of FIG. 1.

As is seen in FIGS. 1 and 3, the transverse or crosswise strings 34 and 36 pass through openings in grommets 38 and 40 which lie on opposite sides of the plane of the string bed. The transverse strings are interwoven with the longitudinal strings, as previously described, with the longitudinal strings 42 and 44 identified in FIGS. 1 and 3. The maintenance of the string bed in the plane is accomplished by the string 34 which goes under the longitudinal edge string 42 passing through the grommet 38 above the plane of the string bed. Similarly, string 36, which passes above the longitudinal edge string 42 in FIG. 3, extends through grommet 40, which is below the plane of the string bed. In this illustration, the strings are one continuous strand which includes string segment 46 seen in FIGS. 2 and 3. The groove 30 extends down the sides of the frame, as seen in FIGS. 2 and 3, so that those string segments are also recessed to avoid abrasive wear.

In the present preferred embodiment, the string holes for the most divergent strings are separated a sufficient distance such that the distance between the string centers of adjacent transverse strings is enough to support the string bed. This separation provides a triangular support at the sides of the string bed, as seen from the plane of the string bed. The stabilization created by this triangular support limits the vibration of both the string bed and the racket frame, which is both heard and felt in the player's arm. Furthermore, the trampoline effect is maintained even though vibration is limited. The vibration limitation is not so much by damping as by firm support at the very edge of the string bed. The player's control is vastly improved, even at a lower stringing tension, and vibration is drastically reduced. The triangular support for the edge of the string bed provides more control and the ability to apply more spin on the ball. Additionally, the triangular support for the string bed permits stringing at a lower tension, which increases the trampoline effect without loss of control. It also drastically reduces vibration. Loss of power due to the triangular support is not a problem since the racket can be strung more loosely and still maintain adequate power with a significant increase in accuracy. In fact, most players experience an increase in applied power since they need not fear vibration or loss of accuracy.

For proper string bed support to provide significant reduction of vibration in both the string bed and frame, at least some of the transverse strings or some of the longitudinal strings are supported by openings in the racket frame which are away from the plane of the string bed. The manner in which the strings interengage at the corners of the string bed and are interwoven and diverged to the frame at the corners is important. Also, the distance of separation of adjacent strings can be increased with resulting increase in the angle of divergence from the string bed. Thus, for different players, particularly professionals, individual rackets can be customized and "tuned" by different numbers of divergent strings and degrees of divergence.

The interlacing of the longitudinal and transverse strings at the corner of the string bed is well shown in the lower right of FIG. 1, and the stringing pattern is shown in FIG. 2. It is assumed in FIG. 2 that the string holes pass straight through the frame of the racket and that they are the same distance from the plane of the string bed on the inside of the frame on the outside. Of course, the string holes could be put at an angle through the frame of the racket, but for simplicity of showing, the center lines of the holes are parallel to the plane of the string bed. Longitudinal string 60 and its end toward the handle passes through opening 62 to the outside of the frame. It crosses at an angle and passes to the interior of the frame through opening 64 to become longitudinal string 66. Longitudinal string 20 passes toward the handle and out opening 70. On the outside of the frame, it goes to opening 72 and becomes longitudinal string 74.

The interlacing of the strings at the corner of the string bed is accomplished by interweaving the transverse strings with the longitudinal strings, providing openings in the racket frame which permit divergence of the transverse strings outside of the string bed, and providing openings which permit the proper angular intersection between the longitudinal and transverse strings at the intersection at the corner.

Transverse strings 76, 78, 80, 82 and 84 are interwoven with the named longitudinal strings and the unnamed longitudinal strings to form the interwoven string bed. As seen in FIG. 1, transverse string 76 extends to the right and over longitudinal string 74 to pass through the string opening 86 in the frame. As seen in FIGS. 1 and 2, this string opening 86 is below the string bed plane in FIG. 1 to pull the longitudinal string 74 away from the viewer in FIG. 1. The string crosses over on the outside of the frame and goes to the inside through string opening 88, which is on the near side of the string bed plane, as seen in FIG. 1, and thence it passes under the first longitudinal string 74. Transverse string 80 passes on the near side of longitudinal string 74 and passes out through string opening 90.

On the outside of the frame, the string passes back to the string bed through string opening 92, which lies on the same side of the string bed plane as the opening 90. This is because the string 82 engages on the near side of string 20. This organization of the stringing permits divergent support of the transverse strings on the string bed. Finally, string 84 passes out through string opening 94 after it crosses over the top of string 66. By this arrangement, interweaving of the strings in the string bed is accomplished even at the corners of the string bed in a manner to provide support for the string bed on both sides of the plane of the string bed. It is important to note that, in the preferred embodiment illustrated, the longitudinal strings in the corners are not straight, but are deflected by the angularity of the transverse strings out of the string bed at the corners. This angularity of the transverse strings outside of the string bed causes the ends of the longitudinal strings to be angular at the edgemost intersection. The openings in the racket frame are placed to accommodate for this angularity. This angularity is best seen in FIG. 1.

Figure 4:
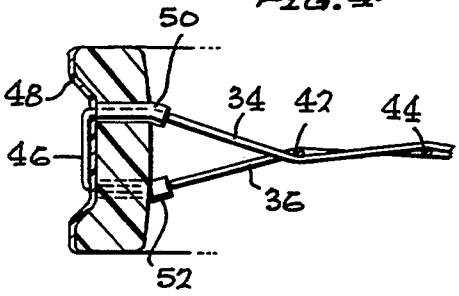
FIG. 4 is a view similar to FIG. 3 showing a different racket frame construction, wherein the racket frame of FIG. 3 has grommets through the frame and the racket frame of FIG. 4 has an exterior wear-resistant cover thereon with guide tubes through the racket frame.

FIG. 4 is the same as FIG. 3, but shows a racket frame which employs a head guard 48 and guide tubes 50 and 52. The head guard 48 is a layer over the entire external portion of the frame to protect the entire frame against abrasion, and the guard tubes 50 and 52 substitute for grommets. This structure accomplishes the same function as the structure of FIG. 3 with guard tubes instead of grommets. Thus, the racket 10 has longitudinal strings which lie in a plane, and these are interwoven with transverse strings, with triangular support at the edges of the string bed as previously described. The racket can alternatively be made with simple holes in the frame, depending on frame and string materials.

The racket 160, shown in FIGS. 6, 7 and 8, is of similar construction as the racket 10 except that all of both the longitudinal and transverse strings are arranged so that they provide triangular support for the string bed along the outside edges of the string bed. The support at the edges of the string bed, all the way around the string bed and including the corners of the string bed, is seen as triangular support between the string bed and the racket frame. The triangles are seen when viewed along the string bed and seeing the divergence of the strings outside of the outermost string. The racket 160 is the second preferred embodiment wherein the string bed is supported by a triangular string pattern at the edges and corners of the string bed. Frame 162 has a handle portion 164 which is the broken-away portion of a conventional tennis racket handle. The direction of the string bed 166 toward and away from the handle, along the 7—7 section line in FIG. 6, is the longitudinal direction in the string bed. The strings positioned at right angles with respect thereto are the transverse strings. In the racket 160, the transverse strings support the string bed with the same triangular support as the transverse strings in the racket 10. The sections of FIGS. 3 and 4 could just as well have been taken in FIG. 6 because the transverse strings in the racket 160 also provide the triangular edge support at the lateral edges of the string bed. The differences between the racket 10 and the racket 160 are that the racket 160 has triangular support for all of the string bed by virtue of all of the longitudinal and transverse strings. The longitudinal strings 168 and 170 are shown in FIGS. 6 and 7. The transverse strings 172,174 and 176 are also shown therein.

The longitudinal strings are interwoven with the transverse strings so that, on the inside of the string bed (which is defined as the outermost interweaving at any point), the string bed is flat. The openings through which the longitudinal strings pass in the frame are separated so that the strings form triangular support, divergent from the string bed plane, for the string bed. For example, at the upper end of the frame 162, as shown in FIG. 7, the string 168 passes through grommet 178 and the string 170 passes through grommet 180. At the inner end of the frame, these grommets are separated from each other to provide the triangular support for the string bed, as is shown in FIG. 7. As has been described with respect to the transverse strings, the centers of the adjacent longitudinal strings are separated on each side of the plane of the string bed at the support point. At the handle end of the frame, grommets 182 and 184 respectively carry the strings 168 and 170 through that portion of the frame. The grommets are useful in protecting the string against abrasion. As seen in FIG. 10, the use of a head guard 186 in association with guard tubes permits a similar geometrical triangular support of the string bed.

FIG. 8 also illustrates the racket 160, with parts broken away. The FIG. 8 view is an inside left upper and lower frame view, each with its own perspective. FIG. 8 also shows the longitudinal strings 188 and 190 to illustrate the complex interweaving of the strings. The inter-engagement of the longitudinal and transverse strings is best shown in the lower left corner of FIG. 8, and the corresponding outer surface of the frame is shown in FIG. 9. Longitudinal strings 192 and 194 are parallel to the longitudinal strings 188 and 190. These four strings respectively pass through the frame through longitudinal string holes 196, 198, 200 and 202. The four handle-most transverse strings 206, 208, 174 and 176 are interwoven with the longitudinal strings in the string plane and respectively pass through the frame respectively through transverse string holes 214, 216, 218 and 220. In FIG. 9, these string holes are viewed from the outside of the racket frame and, in this case, the string holes are drilled through the racket frame in planes away from the string bed plane. The string holes 214, 218, 220 and 200 are on the far side of the string bed plane, as seen in FIG. 8, while the string holes 216, 196, 198 and 202 are on the near side of the string bed plane, as seen in FIG. 8.

There are two interesting things about these holes and the manner in which the strings are engaged therethrough. The transverse string holes 218 and 220 are on the same side, i.e., the far side, of the string bed even though they receive strings adjacent to the transverse strings. This is because initially they engage over adjacent longitudinal strings, as is seen in FIG. 8. It also is important to note that, in the embodiment illustrated, the obtuse angle of string 174 where it crosses string 188 and the obtuse angle of string 188 where it crosses string 174 cause the holes in the frame to be positioned more closely to each other than if these strings were almost straight, as is found in ordinary rectangular string bed weaving. The bisectors of these two obtuse angles are coincident with each other. This causes an apparent bend in these strings where they cross each other when viewed in a direction at a right angle to the string bed plane, substantially as seen in FIG. 8. With proper placement of the grommets or other string guides through the frame and proper interweaving and tension, the string bed lies perfectly flat and is supported around all of its edges and corners with support from both sides of the string bed plane. The triangular support provides firm string bed support immediately at the edges of the string bed for reducing vibration of the string bed and the racket frame, thus resulting in improved performance.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A racket comprising:

a frame, handle means on said frame for manipulating said frame, said frame having a longitudinal direction extending from said handle means upward through said frame and having a transverse direction substantially at right angles to said longitudinal direction, said frame defining an opening therein, a string bed plane in said opening, said string bed plane having first and second sides, walls in said frame defining string holes for strings which are interwoven to form a string bed in said string bed plane, at least some of said holes extending to said frame opening on opposite sides of said string bed plane; and strings through said holes, said strings being interwoven within said frame to define a string bed within the periphery of said interwoven strings, said string holes in said frame being positioned and said strings being interwoven in such a manner that, within said periphery, said string bed has a plurality of longitudinal strings lying substantially parallel to said longitudinal direction and has a plurality of transverse strings lying substantially parallel to said transverse direction, at least some of said longitudinal and said transverse strings being interwoven to form a string bed laterally defined by said interwoven strings, said strings being arranged so that some consecutive longitudinal strings pass from said frame to said string bed plane on the same side of said string bed plane and some consecutive longitudinal strings pass from said frame to said string bed plane alternately from said first and second sides of said string bed plane and where some consecutive transverse strings pass from said frame to said string bed plane on the same side of said string bed plane and some consecutive transverse strings pass from said frame to said string bed plane alternately from said first and second sides of said string bed plane so that said string bed is supported all the way around and in the corners by strings which are divergent from said string bed plane only outside of the string bed to provide support for said string bed.

2. The racket of claim 1 wherein a longitudinal string and a transverse string engage each other at a corner of said string bed and each bends in an obtuse angle at their inter-engagement point to diverge outside of said string bed, the bisectors of said obtuse angles being coincident.

3. The racket of claim 2 wherein said strings at said engagement point bend at an angle toward said frame as viewed toward said string bed and pass through string holes in said frame to maintain said strings divergent from said plane outside of said string bed.

4. A racket comprising:

a frame, handle means on said frame for manipulating said frame, said frame having a longitudinal direction extending from said handle means upward through said frame and having a transverse direction substantially at right angles to said longitudinal direction, said frame defining an opening therein, a string bed plane in said opening, said string bed plane having first and second sides, walls in said frame defining string holes for strings which are interwoven to form a string bed in said string bed plane, at least some of said string holes extending to said frame opening on opposite sides of said string bed plane; and strings through said string holes, said strings being interwoven within said frame to define a string bed within the periphery of said interwoven strings, said string holes in said frame being positioned and said strings being interwoven in such a manner that, within said periphery, said string bed has a plurality of longitudinal strings lying substantially parallel to said longitudinal direction and has a plurality of transverse strings lying substantially parallel to said transverse direction, at least some of said longitudinal strings and some of said transverse strings being interwoven to form a string bed laterally defined by said interwoven strings, said strings being arranged so that at least some of said longitudinal strings extend to said string bed from said first side of said string bed plane and pass the nearest transverse string on said second side of said string bed plane, and at least some of said longitudinal strings extend to said string bed from said second side of said string bed plane and pass the nearest transverse string on said first side of said string bed plane, adjacent ones of said longitudinal strings at a corner of said string bed pass string holes in said frame on the same side of said string bed plane, each transverse string passing through its hole on said first side of said string bed plane passes on the second side of the nearest longitudinal string and each transverse string passing through its hole on said second side of said string bed plane passes on the first side of the nearest longitudinal string so that said string bed is supported all the way around and in the corners by strings which are divergent from said string bed plane only outside of said string bed to provide support for said string bed.

5. The racket of claim 4 wherein adjacent ones of said transverse strings at a corner of said string bed pass through frame holes in said frame on the same side of said string bed plane.

6. The racket of claim 5 wherein said adjacent longitudinal strings pass through frame holes on one side of said string bed plane while adjacent ones of said transverse strings pass through frame holes on the opposite side of said string bed plane.

7. A racket comprising:

a frame, said frame having an open interior for the stringing of strings therein, a string plane within said open interior and intersecting said frame, said string plane having first and second sides, string holes in said frame around said open interior of said frame, some of said string holes in said frame entering into said open interior of said frame on said first side of said string plane and some of said string holes in said frame entering into said open interior of said frame on said second side of said string plane;

longitudinal and transverse strings engaged in said string holes and across said open interior of said frame, said strings engaging each other to define a string bed in said string plane, some consecutive longitudinal strings passing through string holes on said first side of said plane, said some consecutive longitudinal strings being interwoven with the same number of consecutive transverse strings passing through string holes on said second side of said string plane so that said string bed is supported by divergent strings at at least two of its corners.

8. The racket of claim 7 wherein said longitudinal strings and said transverse strings away from said corners diverge away from said string bed to pass through string holes in said frame.

9. A racket comprising:

a frame, said frame having an open interior for the stringing of strings therein, a string plane within said open interior and intersecting said frame, said string plane having first and second sides, handle means on said frame for manual manipulation of said racket, string holes in said frame around said open interior of said frame, said string holes being sized to carry racket strings therein, some of said string holes in said racket frame being on said first side of said string plane and some of said string holes being on said second side of said string plane;

strings engaged in said string holes and extending across said opening in said frame, said strings comprising longitudinal and transverse strings crossing each other and being in contact with each other to define a string bed, said string bed lying substantially in said string plane, said strings between said string bed and said frame diverging from said string plane to said string holes in said frame so as to support said string bed at its edges, at least some consecutive strings of said longitudinal strings passing into string holes on one side of said string plane and at least some consecutive strings of said longitudinal strings passing into string holes on opposite sides of said string bed plane and at least some consecutive strings of said transverse strings passing to string holes on the same side of said string bed plane and other consecutive transverse strings passing to string holes on opposite sides of said string bed plane so as to support said string bed from said frame all the way around said string bed and said frame.

10. A racket comprising:

a frame, said frame having an open interior for the stringing of strings therein, a string plane within said open interior and intersecting said frame, said string plane having first and second sides, handle means on said frame for manual manipulation of said racket, string holes in said frame around said open interior of said frame, said string holes being sized to carry racket strings therein, some of said string holes in said racket frame being on said first side of said string plane and some of said string holes being on said second side of said string plane;

strings engaged in said string holes and extending across said opening in said frame, said strings comprising longitudinal and transverse strings crossing each other and being in contact with each other to define a string bed, said string bed lying substantially in said string plane, said strings between said string bed and said frame diverging from said string plane to said string holes in said frame so as to support said string bed at its edges, each said longitudinal string passing from its string hole on said first side of said plane engaging on said second side of the first transverse string it reaches, said longitudinal string passing from its string hole on said second side of said plane engaging said first side of the first transverse string it reaches, and, at some of the corners of said string bed, adjacent ones of said longitudinal strings pass into string holes in said frame on the same side of said string plane.

11. A racket comprising:

a frame, said frame having an open interior for the stringing of strings therein, a string plane within said open interior and intersecting said frame, said string plane having first and second sides, handle means on said frame for manual manipulation of said racket, string holes in said frame around said open interior of said frame, said string holes being sized to carry racket strings therein, some of said string holes in said racket frame being on said first side of said string plane and some of said string holes being on said second side of said string plane;

strings engaged in said string holes and extending across said opening in said frame, said strings comprising longitudinal and transverse strings crossing each other and being in contact with each other to define a string bed, said string bed lying substantially in said string plane, said strings between said string bed and said frame diverging from said string plane to said string holes in said frame so as to support said string bed at its edges, each said longitudinal string passing from its string hole on said first side of said plane engaging on said second side of the first transverse string it reaches, said longitudinal string passing from its string hole on said second side of said plane engaging said first side of the first transverse string it reaches, each transverse string coming from a string hole on said first side of said plane engaging on the second side of the first longitudinal string it reaches and each transverse string coming from a string hole on said second side of said plane engaging the first side of the first longitudinal string it reaches, said longitudinal and transverse strings inter-engage each other and, at a corner of said string bed, some consecutive longitudinal strings pass through string holes on said first side of said string plane and are interwoven with the same number of consecutive transverse strings passing through string holes on said second side of said string plane so as to support said string bed from said frame all the way around said string bed and said frame.

12. A racket comprising:

a frame, said frame having an open interior for the stringing of strings therein, a string plane within said open interior and intersecting said frame, said string plane having first and second sides, handle means on said frame for manual manipulation of said racket, string holes in said frame around said open interior of said frame, said string holes being sized to carry racket strings therein, some of said string holes in said racket frame being on said first side of said string plane and some of said string holes being on said second side of said string plane;

strings engaged in said string holes and extending across said opening in said frame, said strings comprising longitudinal and transverse strings crossing each other and being in contact with each other to define a string bed, said string bed lying substantially in said string plane, said strings between said string bed and said frame diverging from said string plane to said string holes in said frame so as to support said string bed at its edges, each said longitudinal string passing from its string hole on said first side of said plane engaging on said second side of the first transverse string it reaches, each said longitudinal string passing from its string hole on said second side of said plane engaging said first side of the first transverse string it reaches, each transverse string coming from a string hole on said first side of said plane engaging on the second side of the first longitudinal string it reaches and each transverse string coming from a string hole on said second side of said plane engaging the first side of the first longitudinal string it reaches, some consecutive longitudinal strings pass through string holes on said second side of said string plane and are interwoven with the same number of consecutive transverse strings passing through string holes on said first side of said string plane so as to support said string bed from said frame all the way around said string bed and said frame.

13. The racket of claim 12 wherein said longitudinal and transverse strings inter-engage each other and at a corner of said string bed some consecutive longitudinal strings pass through string holes on said first side of said string plane and are interwoven with the same number of consecutive transverse strings passing through string holes on said second side of said string plane.

14. The method of forming a racket with a firmly supported string bed comprising the steps of:

forming a racket frame having an opening therein and having a string plane having first and second sides in the opening;

forming string holes in the frame with some of the string holes positioned to intersect said opening on the first side of the string plane and some of the string holes positioned to intersect said opening on the second side of the string plane;

stringing the racket frame with string through the string holes extending in first and second directions and interweaving the string within the frame opening to form an interwoven string bed which lies on the string plane and with the strings extending from the frame to the string bed engaging and wrapping partly around the outermost string in the string bed to extend exteriorly of the string bed divergent from the string plane at least partway around the string bed to support the string bed within the frame by divergent strings at at least a portion of the edge of the string bed including stringing the racket frame with string so that some consecutive strings in the first direction pass on one side of the plane of the string bed and other consecutive strings in the first direction extend to string holes on alternate sides of the string plane and some consecutive strings in the second direction extend to string holes on the same side of the string plane and other consecutive strings in the second direction extend to string holes on alternate sides of the string plane.

15. The method of forming a racket with a firmly supported string bed comprising the steps of:

forming a racket frame having an opening therein and having a string plane having first and second sides in the opening;

forming string holes in the frame with some of the string holes positioned to intersect said opening on the first side of the string plane and some of the string holes positioned to intersect said opening on the second side of the string plane;

stringing the racket frame with string through the string holes extending in first and second directions and interweaving the string within the frame opening to form an interwoven string bed which lies on the string plane and with the strings extending from the frame to the string bed engaging and wrapping partly around the outermost string in the string bed to extend exteriorly of the string bed divergent from the string plane at least partway around the string bed to support the string bed within the frame by divergent strings at at least a portion of the edge of the string bed and the stringing of the racket frame includes stringing of adjacent strings in the first direction through string holes on the first side of the string plane.

16. The method of forming a racket with a firmly supported string bed comprising the steps of:

forming a racket frame having an opening therein and having a string plane having first and second sides in the opening;

forming string holes in the frame with some of the string holes positioned to intersect said opening on the first side of the string plane and some of the string holes positioned to intersect said opening on the second side of the string plane;

stringing the racket frame with string through the string holes extending in first and second directions and interweaving the string within the frame opening to form an interwoven string bed which lies on the string plane and with the strings extending from the frame to the string bed engaging and wrapping partly around the outermost string in the string bed to extend exteriorly of the string bed divergent from the string plane at least partway around the string bed to support the string bed within the frame by divergent strings at at least a portion of the edge of the string bed and the stringing of the racket frame includes stringing of adjacent strings in the second direction through string holes on the first side of the string plane.

17. The method of claim 16 wherein the stringing of the racket frame includes stringing of adjacent longitudinal strings through string holes on the first side of the string plane.

18. A racket comprising:

a frame, said frame having an open interior for the stringing of strings therein, a string plane within said open interior and intersecting said frame, said string plane having first and second sides, string holes in said frame around said open interior of said frame, some of said string holes in said frame entering into said open interior of said frame on said first side of said string plane and some of said string holes in said frame entering into said open interior of said frame on said second side of said string plane;

longitudinal and transverse strings engaged in said string holes and across said open interior of said frame, said strings engaging each other to define a string bed in said string plane, some consecutive strings of said longitudinal strings passing through string holes on said first side of said plane and some other consecutive strings of said longitudinal strings alternately passing through string holes on said first side and said second side of said plane so that some of said longitudinal strings adjacent each other pass through string holes on one side and others of said longitudinal strings adjacent each other pass through string holes on the alternate sides of said plane so that said string bed is supported by divergent strings at at least two locations and at least one of said locations is a corner of said string bed.

19. The racket of claim 18 wherein some consecutive strings of said transverse strings pass through string holes on the same side of said string plane and some consecutive other strings of said transverse strings pass through string holes on opposite sides of said string plane.

* * * * *